US007763325B1

(12) United States Patent
Paxson

(10) Patent No.: US 7,763,325 B1
(45) Date of Patent: Jul. 27, 2010

(54) METHOD AND APPARATUS FOR THERMAL SPRAYING OF METAL COATINGS USING PULSEJET RESONANT PULSED COMBUSTION

(75) Inventor: Daniel E. Paxson, Parma Heights, OH (US)

(73) Assignee: The United States of America as represented by the National Aeronautics and Space Administration, Washington, DC (US)

( * ) Notice: Subject to any disclaimer, the term of this patent is extended or adjusted under 35 U.S.C. 154(b) by 371 days.

(21) Appl. No.: 11/864,607

(22) Filed: Sep. 28, 2007

(51) Int. Cl.

| | |
|---|---|
| ***B05D 1/08*** | (2006.01) |
| ***B05D 1/10*** | (2006.01) |
| ***B05D 1/26*** | (2006.01) |
| ***C23C 4/08*** | (2006.01) |
| ***B05C 5/04*** | (2006.01) |

(52) U.S. Cl. ..... 427/449; 427/455; 427/456; 427/225; 239/83

(58) Field of Classification Search ..... 427/449, 427/455, 456

See application file for complete search history.

(56) References Cited

U.S. PATENT DOCUMENTS

| | | | | |
|---|---|---|---|---|
| 2,926,855 | A | 3/1960 | Durr et al. | |
| 3,486,331 | A | 12/1969 | Brown | |
| 4,230,748 | A | 10/1980 | Patel | |
| 4,232,056 | A | 11/1980 | Grant et al. | |
| 4,241,723 | A | 12/1980 | Kitchen | |
| 4,330,732 | A * | 5/1982 | Lowther | 313/130 |
| 4,634,611 | A * | 1/1987 | Browning | 427/449 |
| 4,715,807 | A | 12/1987 | Yokoyama et al. | |
| 4,787,837 | A * | 11/1988 | Bell | 425/385 |
| 5,723,187 | A | 3/1998 | Popoola et al. | |
| 5,817,371 | A | 10/1998 | Gupta et al. | |
| 5,820,939 | A | 10/1998 | Popoola et al. | |
| 5,820,940 | A | 10/1998 | Gorynin et al. | |
| 6,001,426 | A * | 12/1999 | Witherspoon et al. | 427/449 |
| 6,123,999 | A | 9/2000 | Felix et al. | |
| 6,161,506 | A | 12/2000 | Hanson | |
| 6,368,727 | B1 | 4/2002 | Ritter et al. | |

(Continued)

OTHER PUBLICATIONS

Paxson et al, "Ejector Enhanced Pulsejet Based Pressure Gain Combustors: An Old Idea With a New Twist", 41st AIAA/ASME/SAE/ASEE Joint Propulsion Conference, Jul. 10-13, 2005, pp. 1-15, AIAA-2005-4216, American Institute of Aeronautics and Astronautics, Tuscon, Arizona, USA.

(Continued)

*Primary Examiner*—Michael Cleveland
*Assistant Examiner*—Lisha Jiang
(74) *Attorney, Agent, or Firm*—Kenneth Mitchell; Robert H. Earp, III

(57) ABSTRACT

An apparatus and method for thermal spraying a metal coating on a substrate is accomplished with a modified pulsejet and optionally an ejector to assist in preventing oxidation. Metal such as Aluminum or Magnesium may be used. A pulsejet is first initiated by applying fuel, air, and a spark. Metal is inserted continuously in a high volume of metal into a combustion chamber of the pulsejet. The combustion is thereafter controlled resonantly at high frequency and the metal is heated to a molten state. The metal is then transported from the combustion chamber into a tail pipe of said pulsejet and is expelled therefrom at high velocity and deposited on a target substrate.

12 Claims, 10 Drawing Sheets

U.S. PATENT DOCUMENTS

| | | | |
|---|---|---|---|
| 6,379,754 | B1 | 4/2002 | Schlegel et al. |
| 6,491,985 | B2 | 12/2002 | He |
| 6,555,179 | B1 | 4/2003 | Reeves et al. |
| 6,579,573 | B2 | 6/2003 | Strutt et al. |
| 6,745,951 | B2 | 6/2004 | Barrykin et al. |
| 6,863,931 | B2 | 3/2005 | Someno et al. |
| 7,026,016 | B2 | 4/2006 | Bauer |
| 7,043,819 | B1 | 5/2006 | Arnold |
| 7,147,931 | B2 | 12/2006 | Hultin Stigenberg |
| 2003/0064233 | A1 | 4/2003 | He |
| 2004/0250926 | A1 | 12/2004 | Branagan |
| 2005/0014010 | A1 | 1/2005 | Dumm et al. |
| 2005/0064220 | A1 | 3/2005 | Hasz |
| 2005/0118334 | A1 | 6/2005 | Gorman et al. |
| 2005/0260434 | A1 | 11/2005 | Nelson et al. |
| 2006/0093752 | A1 | 5/2006 | Darolia et al. |
| 2006/0112672 | A1* | 6/2006 | Razzell et al. ..... 60/39.77 |
| 2006/0141160 | A1 | 6/2006 | Hasz |
| 2006/0188056 | A1 | 8/2006 | Kim et al. |
| 2006/0216430 | A1 | 9/2006 | Deng et al. |
| 2007/0072008 | A1 | 3/2007 | Hultin Stigenberg et al. |
| 2007/0077362 | A1 | 4/2007 | Ruzzo et al. |

OTHER PUBLICATIONS

Paxson et al, "Experimental Investigation of Unsteady Thrust Augmentation Using a Speaker-Driven Jet", 42nd AIAA Aerospace Sciences Meeting, presented Jan. 5-8, 2004, pp. 607-614, Paper 0092, Reno, Nevada, USA.

Laird, D.E., "Dyna-Jet Basic Dimensions and Specifications". 1997. Two pages, Curtis Dyna-Fog, Westfield, Indiana, USA.

* cited by examiner

METHOD AND APPARATUS FOR THERMAL SPRAYING OF METAL COATINGS USING PULSEJET RESONANT PULSED COMBUSTION

ORIGIN OF THE INVENTION

The invention described herein was made by an employee of the United States Government, and may be manufactured and used by the government for government purposes without the payment of any royalties therein and therefor.

FIELD OF THE INVENTION

This invention is in the field of the surface deposition of protective metallic coatings.

BACKGROUND OF THE INVENTION

There are several known methods of thermal spraying. In these methods, a coating material, such as a metal in the form of powder is fed into a flame. The flame melts the metal powder, so that it can be deposited onto a surface as a coating. An important measurement of quality in most thermal spraying methods is the adhesion of the coating on the surface. A higher velocity thermal spray is generally preferred as the impingement of the coating material onto the deposition surface at higher velocity, typically results in coatings which exhibit better adhesion to the deposition surface. An additional concern common to most methods of thermal spraying is to avoid overheating the coating material which can lead to vaporization or oxidation and reduce the overall quality of the coating produced. In addition, it is also desirable to produce small droplets of material to ensure even coating and maximize surface to volume ratios in order to enhance adhesion and quality of the coating produced.

In the field of thermal spraying, there are several methods that attempt to optimize the velocity of the deposition without degrading the quality of the material to be deposited. Most thermal spray methods seek to reduce the residence time in the heating device to minimize the formation of oxides in the coating material. Also, many thermal sprays use a coating material in powder form in order to optimize the surface to volume ratio of the coating material. However, the use of powder may require special delivery and metering equipment and can lead to delivery problems within the thermal spray device.

Systems known to exist which may be somewhat functionally similar to the technique of this application utilize pulsed detonation technology (rather than resonant deflagration) to achieve high velocity, molten material. Pulsed detonation systems, while achieving higher temperatures and velocities than the instant invention are far more complex to achieve and control. They require multi-valved actuation and forced fuel and air. As such they are non-mobile and very expensive. Their operational frequencies (pulse rates) are also considerably lower than pulsejet based combustion systems of the instant invention so that high deposition rates are more difficult to achieve.

U.S. Pat. No. 2,926,855 discloses an Atomizing and Spraying Apparatus wherein an acoustic jet resonator has a chamber and tube which are both excited at their natural frequency and heated by the pulsating flow of exhaust gases from the internal combustion device to spray a liquid. This reference teaches spraying a liquid material using exhaust fumes.

U.S. Pat. No. 6,745,951 B2 to Barykin et al discloses using a detonation spray gun to produce high energy explosions to thermally spray a coating initially supplied as a powder. This reference requires the use of coating material in a powder form and special precautions to detonate gases without causing continuous explosions or a distribution of the powder within the barrel of the device due to the highly explosive nature of the reactant gases.

U.S. Pat. No. 4,232,056 teaches a method for using a thermospray gun to melt a metallic coating material and impinge the molten coating particles against a metallic substrate. The thermospray gun utilizes an oxy-fuel gas flame spraying gun or electric arc gun in a continuous process.

U.S. Pat. No. 6,579,573 B2 teaches a method for forming a nanostructured coating using ultrasound to form a solution with dispersed nanostructured particles using an ultrasonic horn as a sound source. This reference discloses a high velocity oxy-fuel (HVOF) for depositing a coating. High velocity oxy-fuel processes are continuous and require high outputs of energy to maintain a high velocity stream.

None of the references employ a pulsejet having metal wire fed into the combustion chamber to produce high volume, high velocity surface deposition of a protective metallic coating.

SUMMARY OF THE INVENTION

A method has been devised for high volume, high velocity surface deposition of protective metallic coatings on otherwise vulnerable surfaces. The structure which carries out the method is also disclosed herein. The method is a form of thermal spraying whereby the material to be deposited is heated to the melting point by passing it through a flame. In such systems the molten material is normally transported to the deposition surface by the jet formed from the combustion products. Normally, because steady combustion occurs at relatively low gas velocities, the speed at which the molten particles impinge on the deposition surface is low. This in turn yields relatively low adhesion characteristics for the deposited material. The method described herein utilizes non-steady combustion processes (i.e. high frequency, periodic, confined volume) which generate not only higher velocities, but also use a resonant process requiring no external actuation or control, and no high pressure supply of fuel or air. Optionally, as disclosed hereinbelow combustion chamber pressure may be used to control the deposition process if desired. Velocity increases or decreases as a function of combustion chamber pressure increasing or decreasing and, therefore, velocity may be controlled by varying the fuel-air ratio and/or by increasing the mass of the fuel and the air in a desired proportion within the combustion chamber.

Hence, the disclosed system is potentially simpler than conventional thermal spraying systems. Furthermore, the high heat transfer rates developed allow the deposition material to be introduced, not as an expensive powder with high surface area to volume, but in convenient rod-form, which is also easier and simpler to feed into the system.

Thermal spray coating is not a new technology. It has been around for quite some time and is well developed. There are different techniques utilized which depend on the objective function of the coating, the environment to which the coated piece will be subjected, and the coating material used. In any application, quality is ultimately measured by how well the coating material adheres to the sprayed surface. Adhesion is markedly improved when the coating material is applied at high velocity. There are also the issues of heating temperature and residence time within the combustion chamber. The goal is to achieve a liquid form of the material to be deposited; however, care must be used because excessive heating can lead to vaporization of the deposition material, or worse, chemical reactions such as oxidation. Furthermore, the droplets of deposited material must be small to ensure uniform coating and to maximize surface area to volume ratios in order to enhance adhesion. Because of all the requirements, flame spraying systems are complex, costly, and generally require the part to be brought to the coating machine rather than the other way around. As described briefly above, the instant invention utilizes a low cost combustion system to heat the material. The particular combustion technique naturally generates periodic high velocity flows which greatly enhance adhesion and heat transfer.

Furthermore, the residence times in the combustion device are low and will therefore result in contact with the deposition surface before significant reaction has occurred. Typically, a pulsejet operates at frequencies in excess of 100 Hz. For example, a pulse jet may operate at 220 Hz with the dimensions in this application. Furthermore, the combustion device is mechanically simple, portable, and lightweight and therefore is a mobile, high volume flame spray unit. The combustion device is self-aspirating, requiring no external air or fuel supply energy. The only external power required would be that which controls and actuates the feeding of the coating material into the device. Alternatively, a controller may be used to control the air-fuel ratio and volume. The invention disclosed is inexpensive, mobile, and may produce an exceptionally high material deposition rate, at very high impingement velocity, thus resulting in a quality thermal coating.

In testing, a small access port on the side of the combustion chamber section was utilized. Aluminum material to be deposited was inserted through this port as a 1/16" thick aluminum rod. As such, the rod was fixed such that it protruded approximately 1.25 inches into the 2.5 inch diameter combustion chamber. The notion here was to operate the pulsejet only long enough to melt and deposit this amount of material on the sample. This pulsejet produces approximately 4.25 lbf of thrust when operating. This pulsejet operates at 220 Hz. The thrust production results from a periodic high speed jet which is emitted (due to periodic rapid deflagration) from the tailpipe, downstream of the combustion chamber. The pulsejet was operated for approximately three seconds on a methanol nitromethane mixture to produce a deposition sample. A simple "fingernail" test indicated good adhesion with no preparation performed on the sample surface before the coating. Post-test examination of the aluminum rod indicated that at least half of the 1.25 inch length inserted into the pulsejet combustion chamber was melted.

A method for thermally spraying a metal coating is disclosed and claimed using a modified pulsejet. First a pulsejet is initiated using fuel, air and a spark plug. Next, a solid metal is continuously fed into the combustion chamber of a pulsejet. The heat of combustion is coupled with a high pressure wave produced from combustion to melt a high volume of metal material. A fine molten spray is produced through the interaction with combustion-driven, gasdynamic waves. The waves quickly carry the high volume of metal material at high velocity toward the end of the tail pipe of the pulsejet with low residence time within the pulsejet. A vacuum is formed at the front of the combustion chamber as a high pressure wave or waves travel toward the end of the tail pipe. A substrate is placed in proximity to the end of the tail pipe and the metal material entrained in the products of combustion impinge the surface of a substrate at high temperature and high velocity. Fuel and air are drawn through a valve in the head of the pulsejet into the combustion chamber wherein the vacuum is formed following the combustion of the fuel and the air of the previous cycle.

A pulsejet cycle can be thought of generally as comprising the following sequence: fuel and air are drawn into the combustion chamber through a valve arrangement in the head of the pulsejet; combustion of the fuel and air occurs when the valves in the head of the pulsejet are closed isolating the fuel and the air in the hot combustion chamber of the pulsejet; expulsion of the products of combustion from the combustion chamber through the tail pipe of the pulsejet; and, formation of a vacuum in the combustion chamber of the pulsejet and opening the valves of the head of the pulsejet. The instant invention takes advantage of the pulsejet and continuously feeds solid metal wire into the combustion chamber wherein it is melted into droplets and is conveyed out of the pulsejet in high volume and at high frequency and velocity with the metal kept at high temperatures and short residence times within the combustion chamber. Additionally, the metal may be fed into the pulsejet in the tail pipe section thereof. The metal may also be fed radially or axially into the pulsejet at several different locations. The valve system in this invention is simple and self-actuating after the initial ignition using a spark plug. The pulsejet is lightweight and highly mobile and simple to operate at high frequency.

The invention consists of a process for thermally spray coating metal with pulsed resonant combustion. The apparatus used in this process is a modified pulsejet. The modified pulsejet includes, generally, a head, a combustion chamber, and a tail pipe. The head includes a fuel line, an air line, an eductor, and one or more valves. The combustion chamber is located next to the head and has a sparkplug for initiating combustion. The spark plug may run for several cycles as the pulsejet heats up and begins firing on its own. An access port in the head allows metal wire to be fed therein continuously in solid form. The combustion chamber is formed by the head on one end and a tail pipe on the other end. The tail pipe has a smaller diameter than the combustion chamber.

According to the process, fuel is aspirated from the fuel line into the pulsejet and air is ported through the air line. The spark plug ignites the fuel in the combustion chamber. The combustion provides heat to melt the metal coating material and a pulse wave propels the metal coating material at high velocity down through the tail pipe where it exits the pulsejet and is deposited on a surface. The process is resonant and it relights itself in the next several cycles without requiring additional use of the spark plug.

The method for thermal spraying of coatings using resonant pulsed combustion includes, more specifically, the following steps: initiating the pulsejet; inserting continuously a high volume of metal into a combustion chamber of a pulsejet; combusting resonantly a fuel air mixture in the combustion chamber; heating the metal into a molten metal; producing a fine molten spray through interaction with combustion-driven, gasdynamic waves; moving the molten metal from the combustion chamber into a tail pipe of the pulsejet; transporting the molten metal downstream within the tail pipe of the pulsejet at a high velocity; expelling the molten metal from the tail pipe of the pulsejet in a thermal spray at a high velocity and high frequency oscillation through a thrust augmentation rig; entraining a volume of gas around the molten metal; and depositing the molten metal as a thermal spray onto a sample at the end of the tail pipe. Use of the augmentation rig is optional and could be used for entrainment of inert gas to minimize oxidation.

The pulsejet produces thrust when operating. The thrust production results from a periodic high speed jet which is emitted (due to periodic deflagration) from the tailpipe, downstream of the combustion chamber. In the invention, the material to be deposited is melted in the combustion chamber, then carried downstream and ejected from the tailpipe at high speed wherein it impinges and solidifies on the substrate surface.

The device is self-aspirating and self-actuating at a high frequency (~220 Hz) and low residence time of melted material within the pulsejet to minimize the opportunity for oxidation. In another example, an ejector or a thrust augmentation rig can be located at the end of the pulsejet to entrain an inert gas to reduce oxidation of the coating material.

The device uses a process that is non-steady, periodic, high frequency, high volume, self-aspirating, and self-actuating. The combustion used in this process is non-steady and takes place in a confined volume of the combustion chamber. The process is periodic with a spark plug igniting fuel that is fed into the combustion chamber in the first step. The combustion produces heat and a pulse that include one or more waves. The heat melts the solid coating material and the pulse wave moves the melted coating material.

The pulse wave carries the molten metal material from the combustion chamber down the tail pipe and ejects the molten metal material from the pulsejet with high velocity as it impinges on the surface of a sample. When the pulse wave moves the melted coating material from the combustion chamber down the tail pipe, a vacuum, or low pressure is formed in the combustion chamber next to the head. This low pressure allows the valve to open and receive fuel from the head. The fuel is then ignited in the combustion chamber and the next cycle of combustion takes place. The metal material is melted and the next pulse wave is formed to carry this material down the tail pipe and impinge the coating material into the surface outside of the pulsejet at high velocity. The high velocity ensures that the coating material impinges into and onto the substrate with greater adhesion. The high frequency (~220 Hz) ensures a low residence time which reduces the time for oxidation or other degradation of the coating material to take place due to the exposure to high heat before it reaches the deposition surface. The process repeats at high frequency.

A high volume of coating material can be moved with each combustion step and the process occurs at high frequency, so that a high amount of coating material can be deposited over time. The coating material can be fed into the combustion in a solid rod form. Introduction of the coating material in a solid form is preferred due to cost and material handling convenience. The solid coating material can be fed in continuously as a wire to thermally spray a high volume of coating material in a faster amount of time. As an example a 1/16" aluminum wire was used as previously stated, but other sizes, shapes, forms, and compositions of coating material could be used. For example, wire made from magnesium could also be used. The coating material preferably has a high thermal conductivity and melts in the range of 1100-1500° C. Coating material composition, feed rate, and diameters can be modified to control the deposition rate and various qualities of the coating. Coating material can be introduced in a variety of access port locations into the combustion chamber. Wire is fed continuously with a continuous feeding mechanism at controllable rates. Feed locations of the coating material can include other sites such as coaxially in the combustion chamber, transversely into the combustion chamber, and transversely or coaxially in the tail pipe.

The fuel for combustion in this example is a mixture of methanol and nitromethane. Other fuels such as gasoline may be used. Fuel consumed in a periodic rapid deflagration process produces a high speed jet from the tail pipe at the end of the pulsejet. A pulsejet produces a vortex in the exhaust region outside the tailpipe with each pulse. The exhaust consists of flame spray droplets of coating material, exhaust fumes (combustion products) and air. Air is drawn radially into the tailpipe from the ambient environment surrounding the pulsejet following the expulsion of the exhaust therefrom as the pressure within the combustion chamber is below the ambient pressure.

This pulsejet produces approximately 4.25 lbf of thrust which results from a periodic high speed jet emitted from the tailpipe downstream of the combustion chamber. The quality of the thermally deposited coating is influenced by the operating temperature of the pulsejet and the velocity of the exhaust gases. Both the operating temperature and the velocity of the exhaust gases can be adjusted by controlling the thrust. The combustion chamber pressure can be monitored and is directly related to thrust. The diameter in this example is 2.5 inches at its maximum with the tail pipe diameter of 1.25 inches. Characteristics of the modified pulsejet include simple ignition, smooth self-actuation, and self-aspiration which enables a mobile operation. In one example, a device capable of producing a significant thrust of nearly 4.25 lbf weighs approximately 1 pound. The thrust and hence velocity can also be adjusted by changing the fuel flow or the size of the pulsejet including the diameter.

The thermal spray coating exits the tail pipe at a high velocity. The axial velocity at the tail pipe has different component velocities. The velocities at the tail pipe can be changed based on the pressure in the combustion chamber. The pressure in the combustion chamber can be changed by altering the feed rate of the fuel and air into the head of the pulsejet. Further, the final qualities of the metal coating deposited on the surface can be adjusted based on the velocities at the end of the tail pipe.

Further, unsteady ejectors typically can augment thrust by entraining a lot of fluid, and mixing very rapidly. Additionally, ejectors in this application can be used to entrain fluid to prevent the effluent from the primary jet from reacting with ambient air. It is also possible to optimize the amount of mixing to maintain high velocity and high temperature of the molten deposition material. Entrainment and mixing are controlled by the ejector diameter and length. An ejector may be optimized specifically to maintain high velocity and high temperature of the effluent. The ejector design may be considered to have different dimensions from an ejector design which augments thrust. The ejector may be used to localize the injection of inert gas. One illustration of how this may be done is shown in FIG. 2C.

An effluent comprising a molten metal material is ejected from the tailpipe at high velocity. A flow of inert gas is released from a pressurized ring to combine with the effluent at the entrance to the ejector. The flow of inert gas surrounds the effluent from the primary jet and prevents it from reacting with ambient air. A secondary rig effluent comprising effluent from the primary jet and an inert flow of gas exits the ejector for deposition on the substrate.

The entrainment and mixing of the effluent from the primary jet with the flow of inert gas are controlled by the ejector diameter and length. The ejector helps to prevent the effluent from reacting with ambient air. The ejector is used to keep mixing to a minimum and maintain a high jet velocity and high temperature of the coating material. An ejector may be used which is optimized differently from a thrust augmentation rig. The ejector can be used to localize the introduction of inert gas around the effluent. This design would be portable and avoid having to place the entire apparatus in a giant tank filled with inert gas.

The combustion chamber of the pulsejet includes a pressure tap which can be connected to a pressure transducer controller for measuring the pressure in the combustion chamber. The average pressure can be used to monitor the thrust of the pulsejet to better adjust for the deposition rate and quality of the desired coating.

The high frequency pulsing produces gas dynamic waves which are believed to break the coating into fine particles, producing a more even coating. The gas dynamic waves are formed as part of the combustion which produces heat, pressure, and sound. Selection of the metal material for the coating, dimensions of the composition of the combustion chamber, length, and diameter of the pulsejet, and type of fuel, can be used to adjust the properties of the gas dynamic waves in order to have the optimal effect of the final coating.

The pulsejet is made of materials able to withstand the combustion and the melting temperature range of the metal material to be coated. In this example, the valve body is Aluminum, the combustion chamber and tail pipe are made from Inconel, and the valve covering is made from blue spring steel. The combustion device used in the pulsejet is self-actuating and self-aspirating as a result no external air or fuel supply energy is required after starting the device. Initially air is simplified to the pulsejet an ignition source is provided. The pulsejet includes a simple single valve actuation mechanism which reduces cost, weight, and increases the ease of operation. As a result, a high frequency, high volume thermal spray coating operation can be achieved using a lightweight device that is portable making the thermal spray operation mobile. The thermal spray coating device is portable to accommodate the coating of parts more conveniently than having to bring parts to a stationary, immobile thermal spray coating device.

The method is a form of thermal spraying wherein the material to be deposited is heated to the melting point by passing it through a flame. The method of this invention utilizes intense heat necessary to melt a metallic coating material and high velocity pulses to impinge the metallic coating on a deposition surface. By utilizing heat and velocity together, the problem of a high pressure wave extinguishing the flame does not exist. Additionally, because the heat of the flame and pressure of the wave are coordinated, less energy is required to maintain and fuel a flame continuously.

The method described herein utilizes non-steady high frequency combustion processes which take place in a confined volume. This type of combustion process provides higher temperatures and heat transfer rates which are capable of spraying a higher volume of metallic coatings with a much higher impingement velocity of the thermal spray on the deposition surface. The design of this device is also greatly simplified as a resonant process is self-actuating requiring no external actuation and no high pressure supply of fuel or air. Further, the high heat transfer rates allow the deposition material to be introduced in a solid rod form. As a result, greater efficiency of this thermal spraying method enables a simplified delivery system and lightweight device to be used for thermal spraying.

It is an object of this invention is to provide a method of thermally spraying metallic coatings with good adhesion to a deposition surface.

It is an object of the invention is to use a high volume, high velocity, thermal spray to achieve high quality coatings with strong adhesion to the deposition surface.

It is an object of this invention to provide a method of thermally spraying metallic coatings at high volumetric rates.

It is an object of this invention is to provide a method of thermally spraying metallic coatings with low residence time within the device and thus decreased oxidation.

It is an object of this invention is to provide a method of thermally spraying metallic coatings inexpensively using a light weight pulsejet.

It is an object of this invention is to provide a method of thermally spraying metallic coatings by adjusting the velocity of the pulsejet exhaust to effect the quality of the final metallic coating deposited.

It is an additional object of this invention to provide a method to thermally spray metallic coatings surrounded by inert gas.

It is an object of the invention to control the rate at which the metal wire is inserted into the combustion chamber.

These and other objects of the invention will be best understood when reference is made to the drawings and the description herein below.

The drawings will be best understood when reference is made to the description and claims which follow herein below.

DESCRIPTION OF THE INVENTION

Figure 1:
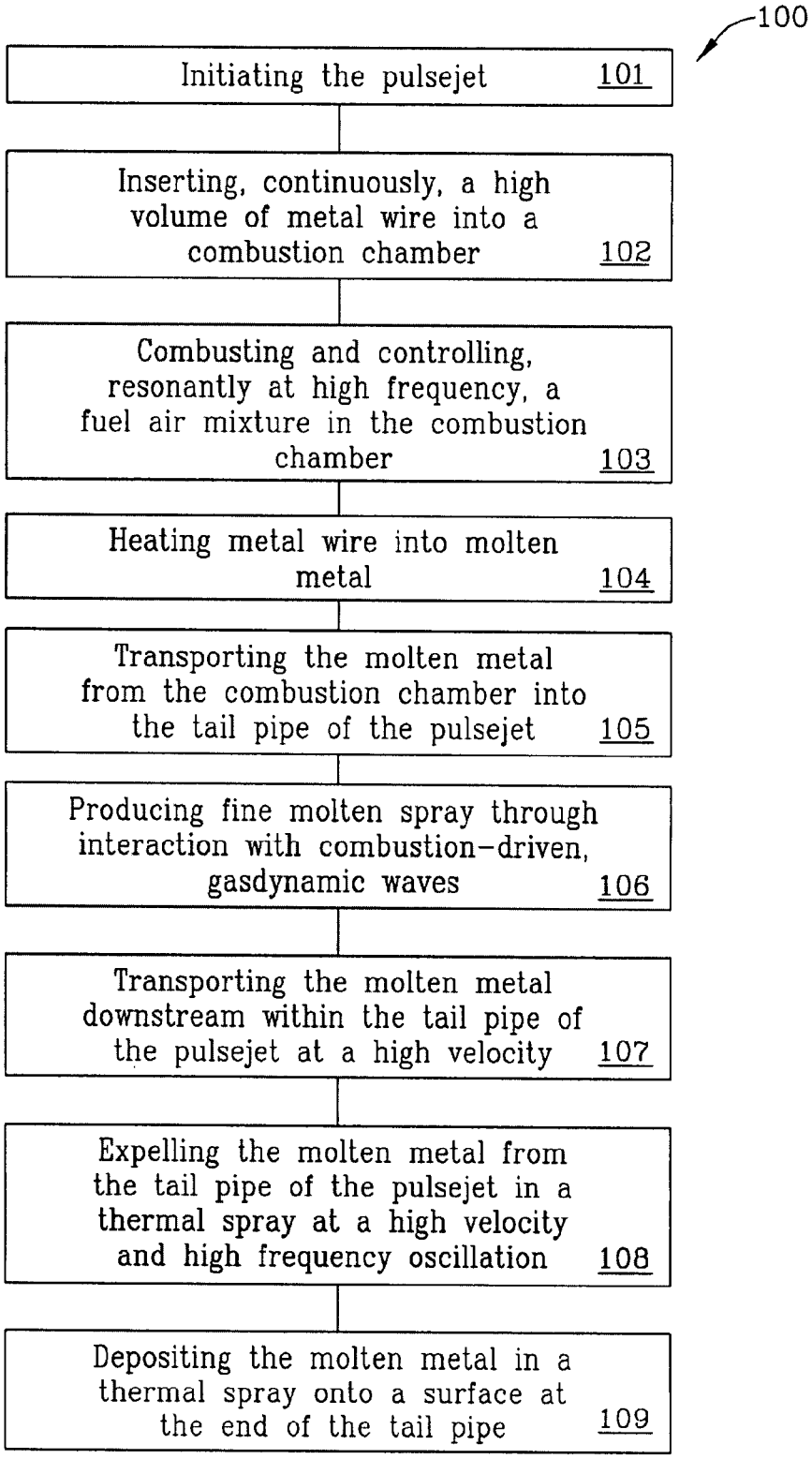
FIG. 1 is a diagram of some of the process steps of the invention.

FIG. 1 is a diagram 100 of some of the process steps of the invention. A method for thermally spraying a metallic coating, includes the steps of initiating a pulse jet 101; inserting, continuously, a high volume of metal into a combustion chamber of the pulse jet 102; combusting and controlling, resonantly, at high frequency a fuel-air mixture in the combustion chamber 103; heating the metal to a molten state 104; transporting the molten metal from the combustion chamber into a tail pipe of the pulse jet 105; producing a fine molten spray through interaction with combustion-driven, gasdynamic waves 106; transporting the molten metal within the tail pipe of the pulse jet at a high velocity 107; expelling the molten metal from the tail pipe of the pulse jet in a thermal spray at a high velocity 108; and, depositing the molten metal in a thermal spray onto a sample at the end of the tail pipe 109.

Figure 2:
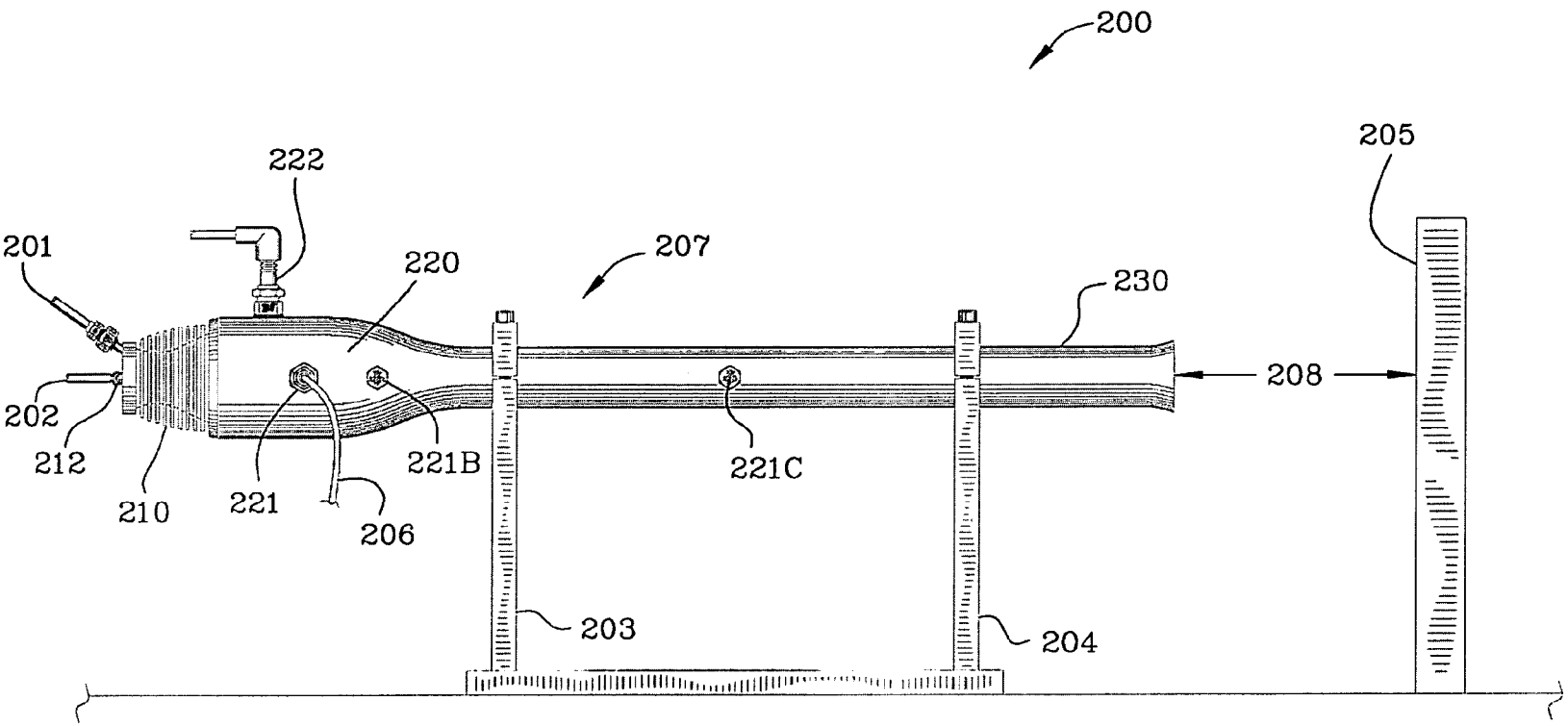
FIG. 2 is a side view of the pulsejet apparatus used for thermally spraying metallic coatings using resonant pulsed combustion.

FIG. 2 is a side view 200 of the pulsejet apparatus used for thermally spraying metallic coatings with resonant pulsed combustion. FIG. 2 illustrates the pulsejet 207 comprising head 210, combustion chamber 220, and tail pipe 230. The head 210 has a stationary air line 201 descending from the upper left and is also connected to a fuel line 202. Head 210 is adjacent to the combustion chamber 220 and resides generally leftwardly of the combustion chamber. Valve seat 319 is located between the combustion chamber 220 and head 210 as illustrated in FIG. 3. Combustion chamber 220 includes spark plug 222 located on the top thereof and extending radially inwardly as viewed in FIG. 3. A tail pipe 230 is integral with the combustion chamber 220 and extends rightward therefrom as viewed in FIGS. 2, 2A, 2B and 3. Combustion chamber 220 and the tail pipe 230 are generally cylindrically shaped and are made of Inconel. Alternatively, the chamber 220 and the tail pipe 230 can be of other materials including a ceramic material. Head 210 has internal geometry shaped in the form of a venturi 314 for the eduction of fuel as viewed in FIG. 3D. The outer diameter of the combustion chamber 220 gradually slopes down to a reduced diameter of the tail pipe 230. The tail pipe 230 diameter is approximately one half the diameter of the combustion chamber 220. Pulsejet 207 is spaced apart a distance 208 from substrate surface 205.

The pulsejet rests on two supports: a first support 203 and a second support 204. Spaced apart 208 from the end of the tail pipe 230 is a substrate surface 205. The substrate surface 205 has a thermally sprayed metal coating 231 deposited thereon in a generally circular shape located generally in-line with the tail pipe 230 as illustrated in FIG. 2A.

Figure 2A:
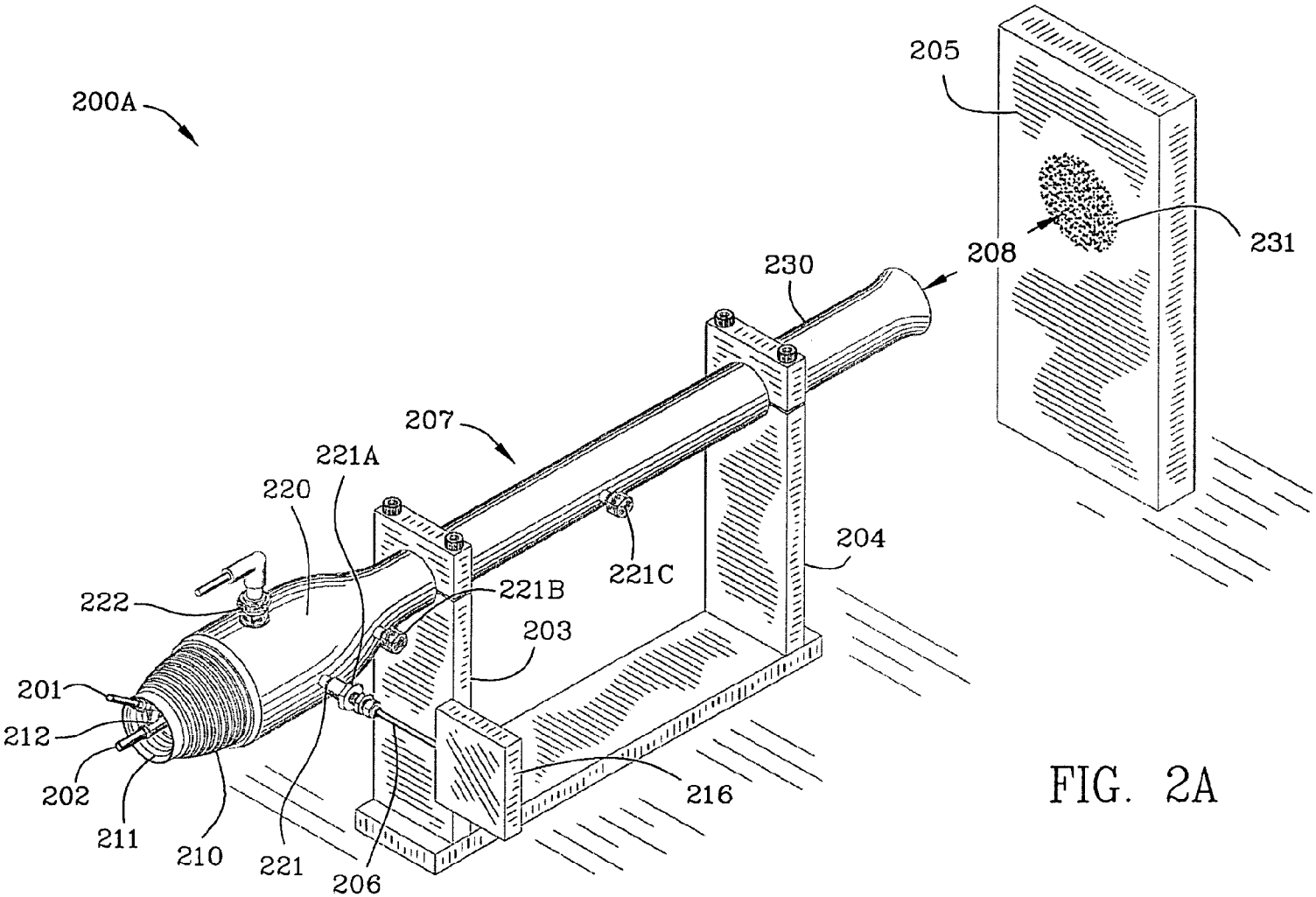
FIG. 2A is a side perspective of the pulsejet apparatus used for thermally spraying metallic coatings using resonant pulsed combustion.
Figure 3:
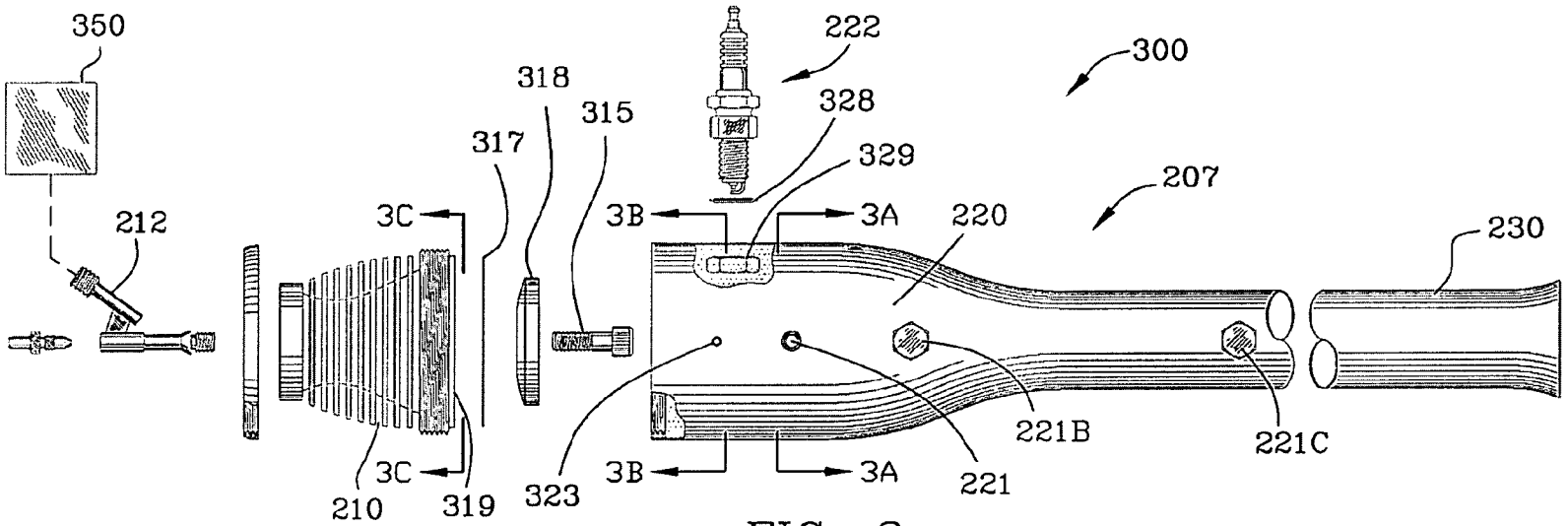
FIG. 3 is an enlarged view of the head and combustion chamber components of the apparatus.

FIG. 2A is a side perspective view 200A of the pulsejet apparatus 207 used for thermally spraying metal coatings using resonant pulsed combustion. FIG. 2A illustrates the head 210 at one end of the pulsejet 207. The pulsejet 207 is generally in the shape of a tube with a wider diameter at one end (head portion) and a generally decreasing diameter towards the opposite end (tail pipe portion). The pulsejet 207 rests on a first support 203 and a second support 204.

Figure 3B:
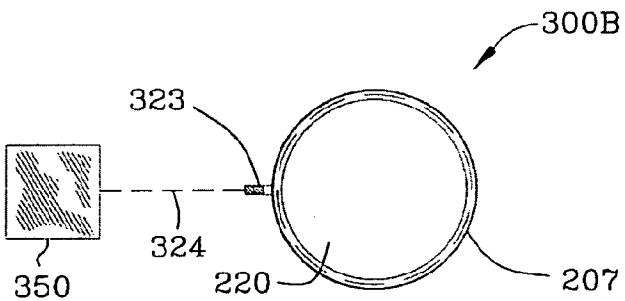
FIG. 3B is a cross-sectional view taken along the lines 3B-3B of the combustion chamber of the pulsejet apparatus for thermally spraying metallic coating using resonant pulsed combustion.

The head includes an eductor 212. The eductor 212 has an inlet 211 open to atmosphere and a fuel line 202. A starting air line 201 is also located in the head 210 and initially supplies air for educting fuel into the combustion chamber 220 much like a carburetor. Adjacent to head 210 is a combustion chamber 220 and between head 210 and combustion chamber 220 is a valve seat 319 as viewed in FIG. 3A. The valve seat 319 is also shown from a rear view of the head 210 in FIG. 3C. The venturi 314 leading from the head 210 to the valve seat 319 is shown in the cross-sectional view in FIG. 3D. Referring to FIG. 3D, valve passageways 313 through the head 210 are illustrated as is the valve seat 319 on the face of head 210. The combustion chamber 220 has an access port 221 located on one side with a metal wire 206 inserted into the access port 221 by an automatic feeding mechanism 216. Fitting 221A secures and seals the metal wire 206 to the combustion chamber 220.

Alternative access ports 221B and 221C are illustrated in FIG. 2A for the admission of wire. Mounted in the top of the combustion chamber 220 is a spark plug 222 which is used to initially begin combustion within the pulsejet. Tail pipe 230 is formed integrally with the combustion chamber 220 and extends rightward with viewing FIG. 2A. The combustion chamber 220 is connected to the head 210 on one side and connected to the tail pipe 230 at the other end. At one end the combustion chamber 220 has a larger diameter approximately equivalent to the diameter of the head 210 at its widest point. At the other end, the diameter of the combustion chamber 220 is reduced to match the diameter of the tail pipe 230. The diameter of the combustion chamber 220 at one end is approximately twice the diameter of the tail pipe 230. The outer diameter of the pulsejet 207 is gently sloped from its widest value near the combustion chamber 220 to the tail pipe 230 wherein the diameter is reduced.

Still referring to FIG. 2A, at the end of the pulsejet, separated by a distance 208 from the pulsejet is the substrate 205. Substrate 205 is illustrated as having a thermally sprayed metal coating 231 thereon as represented by reference numeral 231. The deposited thermally sprayed metal coating 231 is generally cylindrically shaped with a pattern slightly larger in diameter than the tail pipe 230 of the pulsejet 207.

Figure 2B:
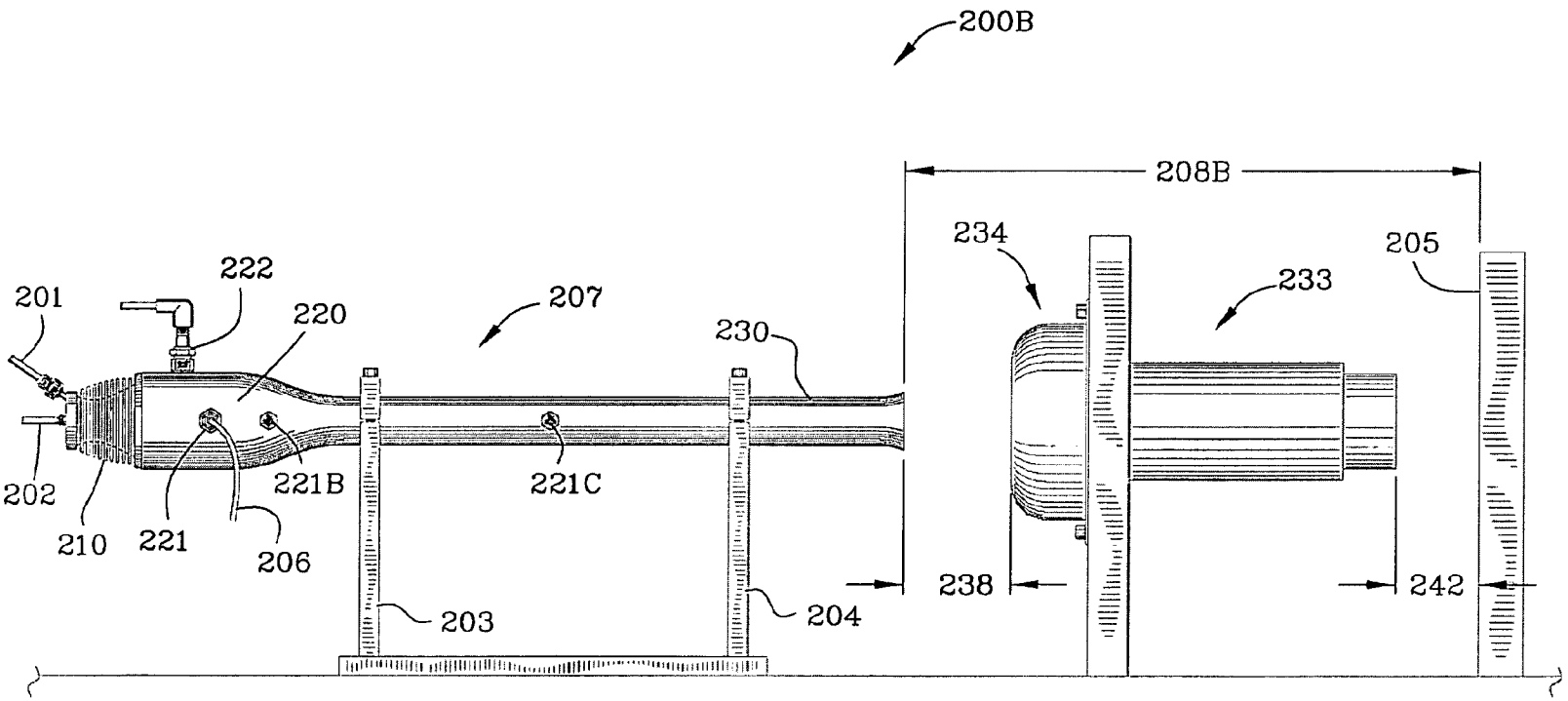
FIG. 2B is a side view of the pulsejet apparatus used for thermally spraying metallic coatings with a thrust augmentation rig for providing an inert gas blanket.

FIG. 2B is a side view 200B of the pulsejet apparatus 207 for thermally spraying metal coatings using resonant pulsed combustion with the ejector 233 spaced apart from the tail pipe 230. Reference numeral 234 signifies the entrance to the ejector 233 wherein entrained inert gas may be used to prohibit oxidation of the thermally sprayed metal coating. Entrainment of inert gas may be routed through the entranceway 234 of the rig or entrainment may occur without the use of the ejector 233 at all. For instance, it is possible for the tail pipe 230 to be surrounded by inert gas with the inlet of the pulsejet (i.e., the head) open to atmosphere as an oxygen source. The combustion chamber of the pulsejet includes a pressure tap 323 located on the sides of the combustion chamber 220 as illustrated in FIG. 3. Still referring to FIG. 2B, reference numeral 238 is the distance between the tail pipe 230 and the entrance of the ejector 234. Reference numeral 208B is the distance between the tail pipe 230 and the substrate 205 and reference numeral 242 is the distance between the ejector and the substrate 205.

Figure 2C:
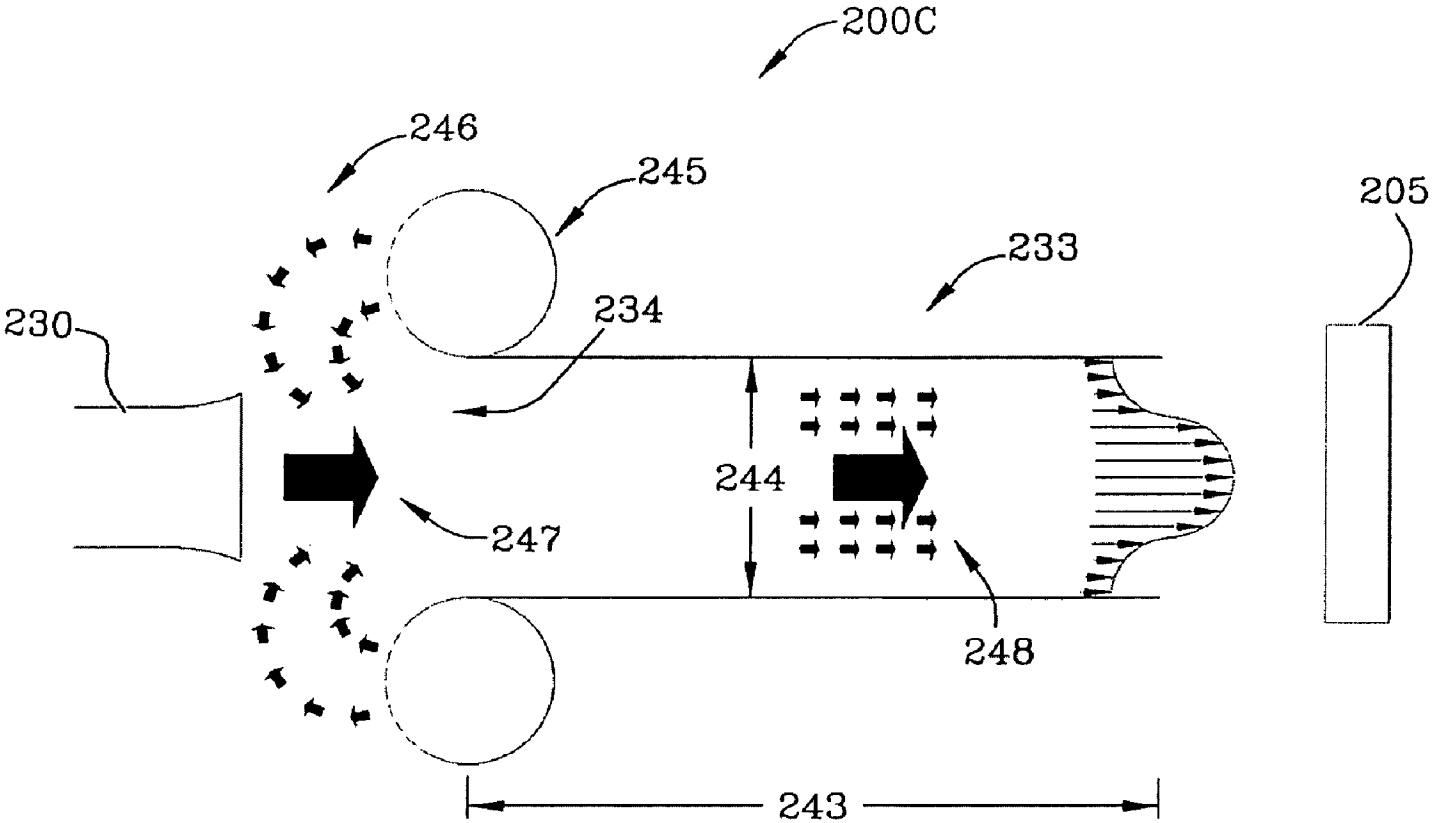
FIG. 2C is an enlarged side view 200C of inert flow entrained into an ejector with the main effluent flow from the primary jet towards the target.

FIG. 2C is an enlarged side view 200C of the flow of inert gas 246 entrained into an ejector 233 with the effluent flow 247 from the primary jet to produce a secondary rig effluent 248 towards the target 205. The ejector 233 has a width 244 and a length 243 which can be modified to change the characteristics of the secondary rig effluent 248. When the effluent 247 is ejected from the tailpipe 230, a pressurized ring 245 releases a flow of inert gas 246 to surround the effluent 247 as the effluent 247 approaches the entrance 234 of the ejector 233. This flow of inert gas 246 prevents the effluent 247 from reacting with the ambient air. The effluent 247 carries a high temperature molten material at high velocity for use in depositing on a surface as a coating. The flow of effluent 247 and inert gas 246 enter the ejector 233 to form a secondary rig effluent 248 which will be expelled from the ejector 233 to coat the substrate surface 205.

FIG. 3 is an enlarged view 300 of the head and combustion chamber components of the apparatus. The head 210 includes valve seat 319 and valve retainer 318 which prevents the over extension of valve seat 319. A valve retainer 318 is located next to the valve seat 319 and prevents the valve cover 317 from being extended too far when opened. A valve retainer bolt 315 is inserted through the valve retainer 318, and valve seat 319 and into the head 210. The combustion chamber 220 has a spark plug 222 inserted into the top side of the combustion chamber 220 as shown in FIG. 3. A spark plug gasket 328 is located on the outside of the combustion chamber 220 with a spark plug nut 329 located on the inner side of the combustion chamber 220 to hold the spark plug 222 in place.

Figure 3A:
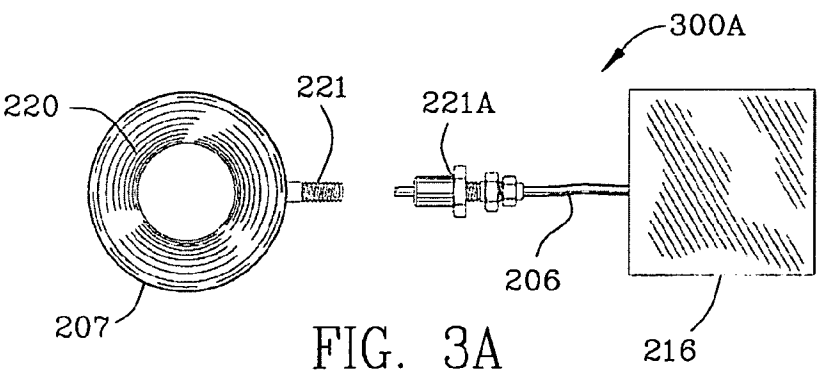
FIG. 3A is a cross-sectional view taken along the lines 3A-3A of FIG. 3 of the combustion chamber of the pulsejet apparatus for thermally spraying metallic coatings using resonant pulsed combustion.
Figure 3D:
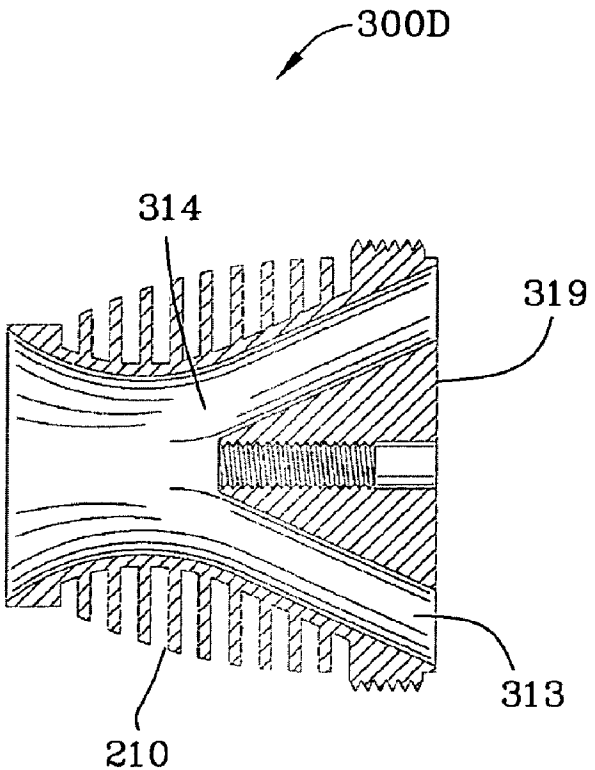
FIG. 3D is a cross-sectional view of the head taken along line 3D-3D of FIG. 3C.

FIG. 3A is a cross-sectional view 300A taken along the lines of 3A-3A of FIG. 3 and illustrates the valve seat 319 in the head 210 of the apparatus for thermal spray of coatings using resonant pulsed combustion in juxtaposition with fitting 221, 221A and feeding mechanism 216 for feeding metal wire 206 into the combustion chamber. Valve seat 319 has a valve cover 317 with individual flappers which correspond to valve passageways 313 equally spaced apart from each other and equally spaced radially from the center point of the head 210. The valve has a threaded receptacle 309.

FIG. 3B is a cross-sectional view 300B taken along the lines 3B-3B of FIG. 3 and illustrates the combustion chamber 220 of the pulsejet apparatus for thermally spraying a metal coating using resonant pulsed combustion illustrating a pressure tap 323 which may be used with a controller 350 for controlling the air-fuel mixture of the pulsejet and hence the combustion within the combustion chamber 220. The combustion chamber pressure is related to the velocity of the discharge of the combustion products and the molten metal which are expelled out of the pulsejet 207. Referring to FIGS. 3 and 3B, controller 350 is illustrated as interfacing a line to the controller 324 with the pressure tap 323 of the combustion chamber and the fuel flow inlet 212 with dotted lines. Necessarily included within the dotted lines are fittings and valves necessary to accomplish the stated objectives.

Figure 3C:
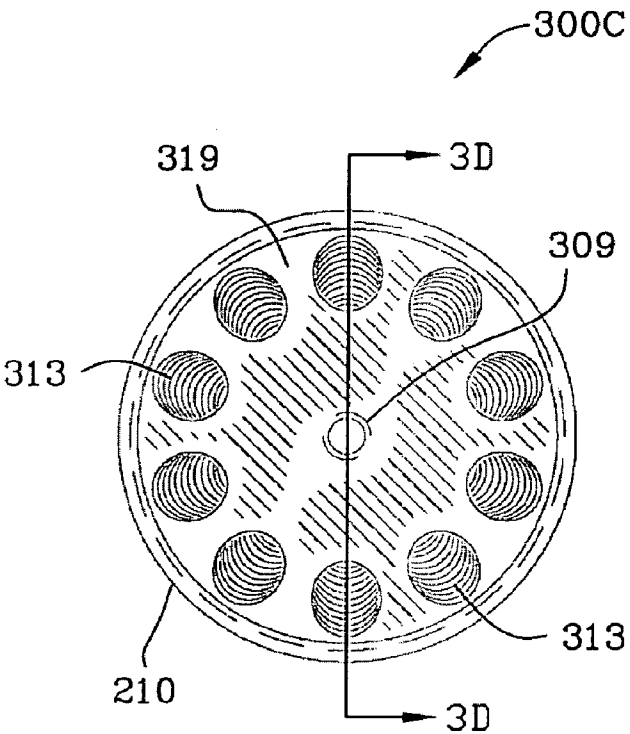
FIG. 3C is an end view of the valve seat taken along the line 3C-3C in FIG. 3.

FIG. 3C is an end view 300C of valve seat 319 of the head 210 illustrating passageways 313 therethrough and a threaded receptacle 309. FIG. 3D illustrates a cross-sectional view of the head 210 taken along the lines 3D-3D of FIG. 3C illustrating a venturi 314 formed within passageway 313.

FIG. 3D is a cross-sectional view 300D of the head taken along line 3D-3D of FIG. 3C illustrating the venturi 314 and the length of the valve passageway 313 in the head 210. The valve seat 319 is located at one end of the head 210.

Figure 3E:
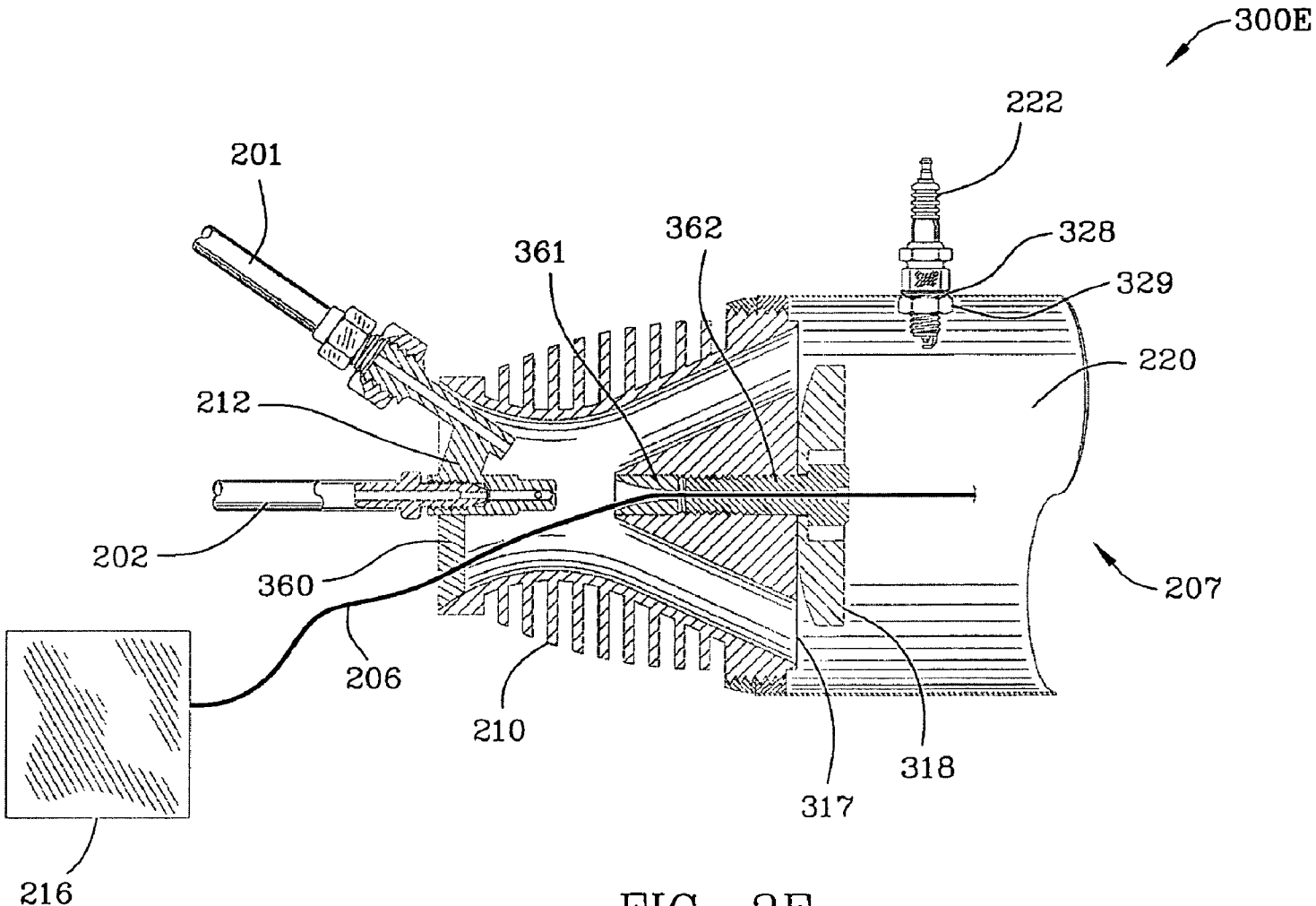
FIG. 3E is a cross-sectional view of an axial feed of wire from the head through a hollow bolt and into the combustion chamber.

FIG. 3E is a cross-sectional view 300E of an axial feed of wire from the head through a hollow bolt 360 and into the combustion chamber 220 of a pulsejet 207. The head 210 has an air inlet 201, a fuel line 202, and an aerodynamic strut 360 with wire 206 fed therethrough. The wire 206 follows a path along the path of a guides 361 through the center of a hollow bolt 362 and into the combustion chamber 220. An air line 201 is used to start the flow of fuel from the fuel line 202 to the head 210 and along the valve passageway 313 where it passes the valve cover 317 and enters the combustion chamber 220. The fuel is ignited initially with a spark from the spark plug 222. The spark plug 222 is inserted though the wall of the combustion chamber and is held in place with a spark plug gasket 328 and a spark plug nut 329.

Figure 4:
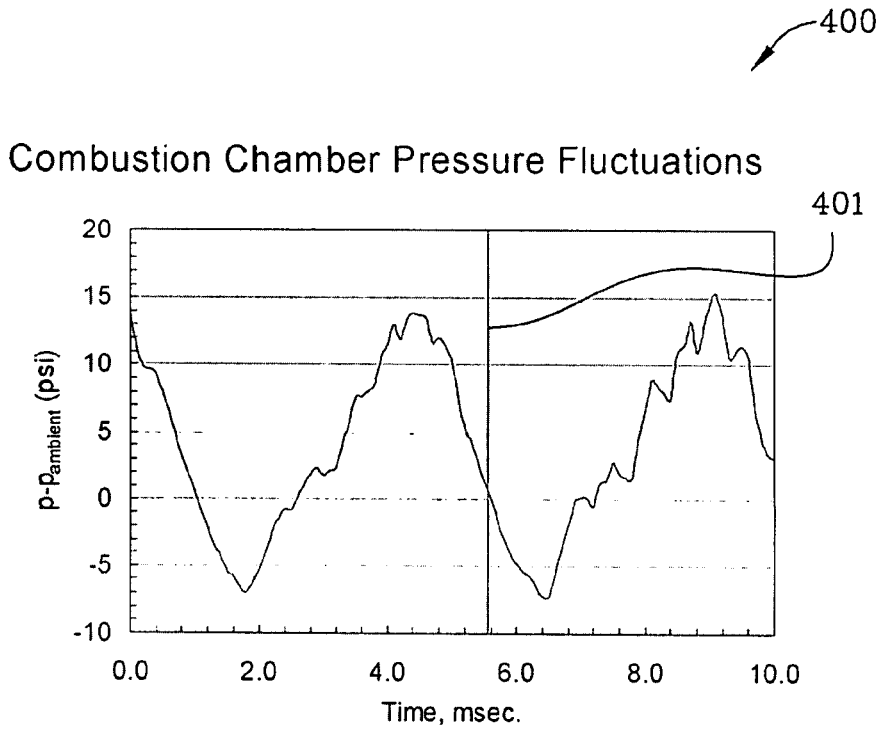
FIG. 4 is a graph of Combustion Chamber Pressure Fluctuations (pressure reading–ambient pressure) (psi) vs. time (sec).

FIG. 4 is a graph 400 of Combustion Chamber Pressure Fluctuations $p\text{-}p_{ambient}$ (psi) vs. time (sec) illustrating pressure fluctuations in the combustion chamber 220 as a function of time. Pressure was measured with a transducer connected to the pressure tap in the side of the combustion chamber demonstrating the resonant periodic cycle of the pulse within the combustion chamber operating at approximately 220 Hz. The rapid cycling within the combustion chamber demonstrates the low residence time of each pulsed thermal spray of metal. Pressure, as previously stated, is a parameter that can be monitored to control the thermal spraying process and the discharge velocity of the pulsejet. Time averaged pressure of the curve presented in FIG. 4 may be useful in controlling the thermal spraying of the metal coating. A specific instant in time $t_1$ is identified on the graph with reference numeral 401. See FIG. 6 wherein the profile of the discharge velocity at time $t_1$ is illustrated.

Figure 5:
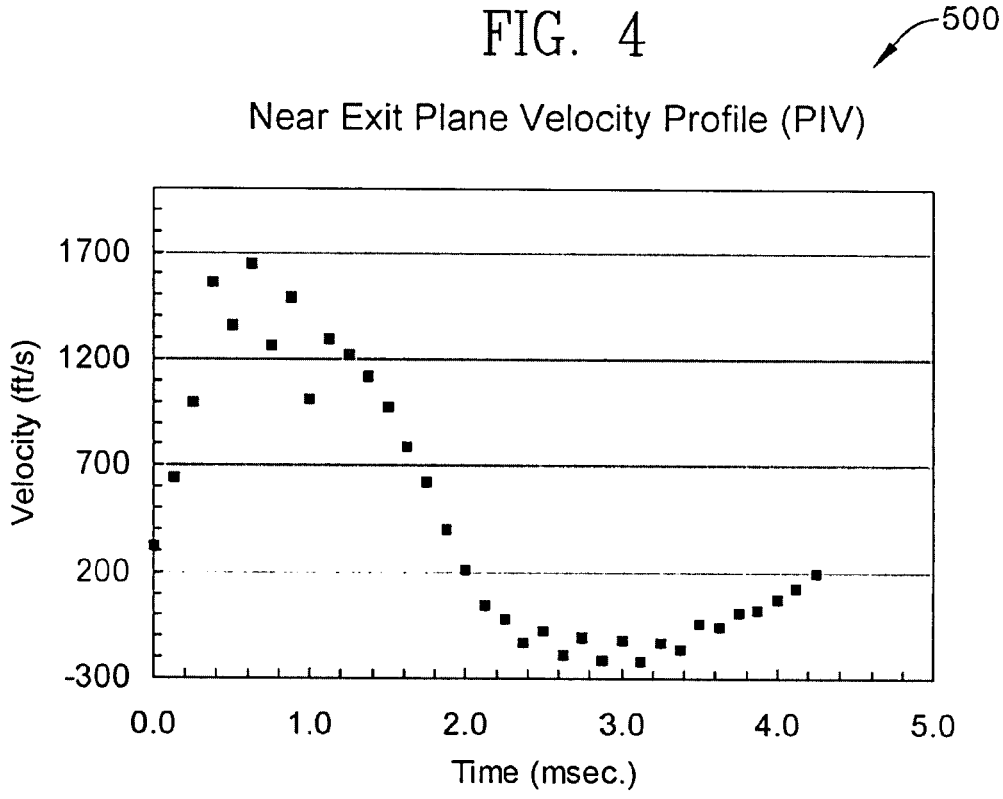
FIG. 5 is a graph of Near Exit Plan Velocity Profile (PIV) of velocity (ft/sec) vs. time (msec.)

FIG. 5 is a graph 500 of Near Exit Plan Velocity Profile (PIV) velocity (ft/sec) vs. time (msec.). This graph shows high velocity of the thermally sprayed metal of approximately 1700 ft/s released from the pulsejet in the exit plane near the end of tail pipe 230. In addition to illustrating high velocity discharge of the pulsejet apparatus, this graph also illustrates the dynamic characteristics of the thermal spray wherein the velocity is approximately negative 300 ft/sec around 2.6 to 3.2 seconds after combustion is initiated. This graph shows that in addition to achieving the high velocity to impinge the thermal spray on a sample, the thermal spray has unique bi-directional flow properties which make it possible, it is believed, to further breakdown the particles of molten metal into very small particles which enhances the coating ability.

Figure 6:
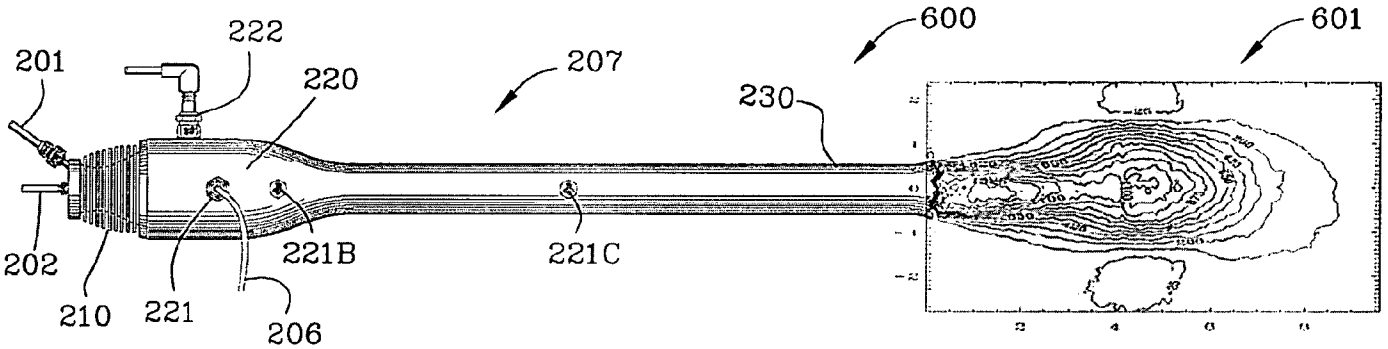
FIG. 6 is a schematic illustration of the pulsejet and the velocity profile exiting the pulsejet.
Figure 6A:
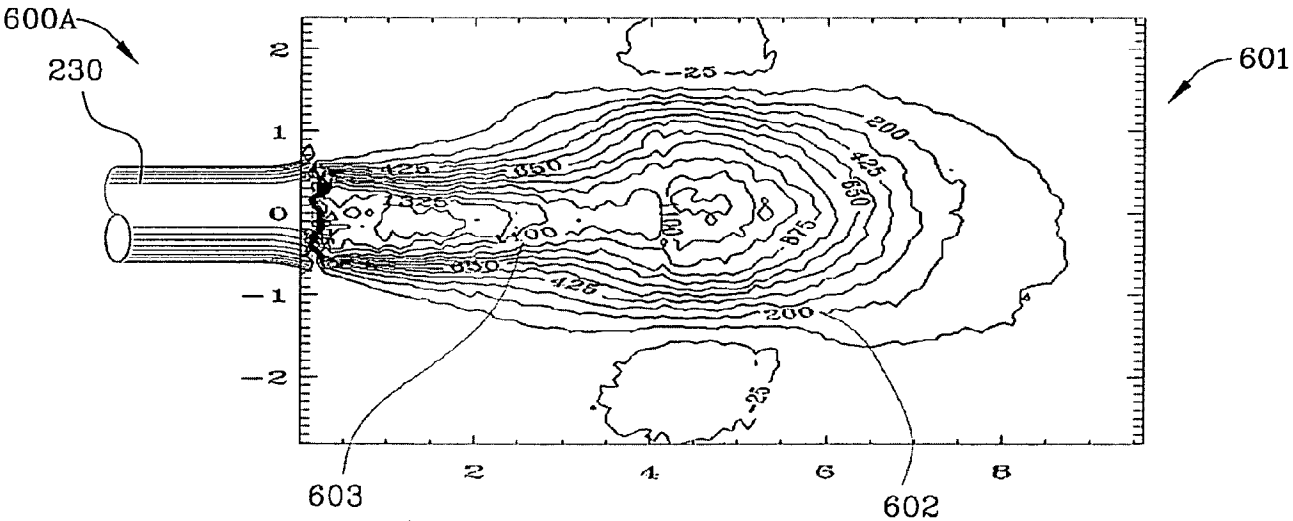
FIG. 6A is an enlarged view of the pulsejet and the velocity contour plot.

FIG. 6 is a side view 600 of the pulsejet with velocity contour plot of the exhaust plume at time $t_1$ designated by reference numeral 401 from FIG. 4. This plot shows the profile of different velocities in the exhaust plume at the end of the tail pipe outside of the pulsejet as the plume emanates therefrom. Units expressed in FIG. 6 are in inches with velocities ranging from about 200-1100 ft/sec. FIG. 6A is an enlarged view of a portion of FIG. 6 illustrating the velocity profile with better resolution. Reference numeral 602 illustrates a contour line of 200 ft/s and reference numeral 603 illustrates a contour line of 1100 ft/s.

FIG. 6A is an enlarged view of the tail pipe 230 and the enlarged contour plot 601 of exhaust velocities shown at $t_1$. Velocity contours are shown with a high velocity contour 603 located near the center of the velocity contour plot at a velocity of approximately 1100 ft/s. Lower velocity contours are located further from the tail pipe 230 at 602 showing a velocity of 200 ft/s.

LIST OF REFERENCE NUMERALS

100 Selected process steps
101 Process step of initiating a pulsejet
102 Process step of inserting, continuously, a high volume of metal into a combustion chamber of the pulsejet
103 Process step of combusting and controlling, resonantly, at high frequency a fuel-air mixture in the combustion chamber
104 Process step of heating the metal to a molten state
105 Process step of transporting the molten metal from the combustion chamber into a tail pipe of the pulse jet
106 Process step of transporting the molten metal within the tail pipe of the pulse jet at a high velocity
107 Process step of expelling the molten metal from the tail pipe of the pulse jet in a thermal spray at a high velocity
108 Process step of depositing the molten metal as a thermal spray onto a surface at the end of the tail pipe
200 Side view of pulsejet
200A Perspective view of pulsejet
200B Side view of pulsejet with thrust augmentation rig
201 Air line
202 Fuel line
203 First support
204 Second support
205 Substrate surface
206 Metal wire

207 Pulsejet
208 Distance from pulsejet to substrate surface
208B Distance from tail pipe to substrate
210 Head
211 Inlet
212 Eductor
216 Feeding mechanism
220 Combustion chamber
221 Access port
221A Fitting for access port
221B Additional location for access port
221C Additional location for access port
222 Spark plug
230 Tail pipe
231 Deposited coating
233 Ejector
234 Entrance to ejector
238 Distance from pulsejet to ejector
242 Distance from pulsejet to substrate surface
243 Length of ejector
244 Width of ejector
245 Pressurized ring
246 Flow of inert gas
247 Primary jet effluent
248 Secondary rig effluent
300 Assembly view of pulsejet
300A Cross-Sectional view of combustion chamber along line 3A-3A
300B Cross-Sectional view of combustion chamber along line 3B-3B
300C End view of head along 3C-3C
300D Cross-Sectional view of head along 3D-3D
309 Threaded Receptacle
313 Valve passageway
314 Venturi
315 Valve retainer bolt
317 Valve cover
318 Valve retainer
319 Valve Seat
323 Pressure tap
324 Line to controller
328 Spark plug gasket
329 Spark plug nut
350 Controller
360 Aerodynamic strut
361 Guide
362 Hollow bolt
400 Graph of combustion chamber pressure fluctuations
401 Specific instant in time $t_1$ relating to FIG. 6
500 Graph of near exit plane velocity profile
600 Side view of pulsejet with contour plot exhaust velocities shown at $t_1$
600A Enlarged view of pulsejet with contour plot
601 Enlarged contour plot of exhaust velocities at $t_1$
602 Contour, 200 ft/s
603 Contour, 1100 ft/s

I claim:

1. A method of spraying a coating, comprising the steps of:
combusting, resonantly, a fuel-air mixture in a pulsejet; and,
inserting continuously a metal wire into said pulsejet.

2. A method as claimed in claim 1 for thermal spraying a metal coating, comprising the steps of:
initiating a pulsejet;
inserting, continuously, a high volume of metal into a combustion chamber of said pulsejet;
combusting and controlling, resonantly, at high frequency a fuel-air mixture in said combustion chamber;
heating said metal to a molten state;
producing a fine molten spray through interaction with combustion-driven, gasdynamic waves;
transporting said molten metal from said combustion chamber into a tail pipe of said pulsejet;
transporting said molten metal within said tail pipe of said pulsejet at a high velocity;
expelling said molten metal from said tail pipe of said pulsejet in a thermal spray at a high velocity; and,
depositing said molten metal as a thermal spray onto a sample at the end of said tail pipe.

3. A method for thermal spraying a coating as claimed in claim 2 further comprising the steps of:
entraining a volume of an inert gas around said molten metal; and,
impinging said molten metal on said sample located in proximity to said tailpipe of said pulsejet.

4. A method for thermally spraying a coating as claimed in claim 2 wherein said metal is selected from the group consisting of aluminum and magnesium.

5. A method for thermally spraying a coating as claimed in claim 2 wherein said fuel mixture comprises a fuel selected from the group consisting of nitromethane, methanol, and gasoline.

6. A method for thermally spraying a coating as claimed in claim 2 wherein said resonant pulsed combustion utilizes a head and a valve between said head and said combustion chamber.

7. A method for thermal spraying a coating as claimed in claim 1 further comprising the steps of:
entraining a volume of an inert gas around said molten metal; and,
impinging said molten metal on said sample located in proximity to said tailpipe of said pulsejet.

8. A method for thermally spraying a coating, comprising the steps of:
inserting a metal wire into a combustion chamber of a pulsejet;
combusting a mixture of fuel and air in said combustion chamber of said pulsejet;
heating said metal wire and forming molten metal particles which travel in a high velocity wave of combustion products into a tail pipe of said pulsejet as a result of said combustion;
expelling said molten metal at a high velocity and frequency;
impinging said molten metal as a thermal spray onto a sample at the end of said tail pipe; and,
forming a vacuum in said combustion chamber further disintegrating any molten metal particles left in said tail pipe and further repeating said steps.

9. A method for thermal spraying a coating as claimed in claim 8 further comprising the steps of:
entraining a volume of an inert gas around said molten metal; and, impinging said molten metal on said sample located in proximity to said tailpipe of said pulsejet.

10. A method for high volume, high velocity surface deposition of protective metallic coatings, comprising the steps of:

creating a non-steady resonant combustion process in a confined volume;

heating a metal to its melting point by passing it through a flame; and, thermally spraying said melted metal on a substrate.

11. A method for high volume, high velocity surface deposition of protective metallic coatings as claimed in claim 10 wherein the step of creating a non-steady resonant combustion process in a confined volume is performed without external actuation or control.

12. A method for high volume, high velocity surface deposition of protective metallic coatings as claimed in claim 10 wherein the step of creating a non-steady resonant combustion process in a confined volume is performed using air-fuel ratio and volumetric control.

* * * * *